US009650796B2

(12) United States Patent
Klingenberg

(10) Patent No.: US 9,650,796 B2
(45) Date of Patent: May 16, 2017

(54) TELESCOPIC OR RETRACTABLE BLEACHER HANDRAIL AND SYSTEM

(71) Applicant: Rodney J. Klingenberg, Holland, MI (US)

(72) Inventor: Rodney J. Klingenberg, Holland, MI (US)

( * ) Notice: Subject to any disclaimer, the term of this patent is extended or adjusted under 35 U.S.C. 154(b) by 67 days.

(21) Appl. No.: 14/522,144

(22) Filed: Oct. 23, 2014

(65) Prior Publication Data

US 2015/0113884 A1 Apr. 30, 2015

Related U.S. Application Data

(60) Provisional application No. 61/895,157, filed on Oct. 24, 2013.

(51) Int. Cl.
*E04H 3/12* (2006.01)
*E04F 11/18* (2006.01)

(52) U.S. Cl.
CPC ..... *E04H 3/123* (2013.01); *E04F 11/1865* (2013.01); *E04H 3/126* (2013.01)

(58) Field of Classification Search
CPC E04H 3/123; E04H 3/126; E04H 3/30; E04H 2003/145; E04F 11/1863; E04F 11/1865; E04F 11/1836; E04F 11/18; E04F 11/1834; E04F 11/1838; E04F 11/1868; E04F 11/1817; E04F 11/1819
See application file for complete search history.

(56) References Cited

U.S. PATENT DOCUMENTS

| | | | | |
|---|---|---|---|---|
| 3,401,918 | A | | 9/1968 | Wiese |
| 3,757,894 | A | | 9/1973 | Chamberlin |
| 3,788,608 | A | | 1/1974 | Raymond et al. |
| 3,964,215 | A | | 6/1976 | Hartman et al. |
| 3,995,832 | A | | 12/1976 | Wiese |
| 4,006,564 | A | | 2/1977 | Wiese |
| 4,014,522 | A | | 3/1977 | Sutter |
| 4,030,255 | A | | 6/1977 | Hartman |
| 4,138,094 | A | | 2/1979 | Thir |
| 4,361,991 | A | * | 12/1982 | Wiese ..... 52/9 |
| 4,571,895 | A | | 2/1986 | Lyman, Jr. |
| 4,611,439 | A | | 9/1986 | Graham, Jr. |
| 4,997,165 | A | | 3/1991 | Wiese |
| 5,661,928 | A | | 9/1997 | Beu |
| 5,667,199 | A | | 9/1997 | Hamm |
| 5,813,663 | A | * | 9/1998 | Victor et al. ..... 256/59 |

(Continued)

*Primary Examiner* — Jessica Laux
(74) *Attorney, Agent, or Firm* — Preti Flaherty Beliveau & Pachios LLP

(57) ABSTRACT

A telescopic and retractable bleacher system and handrail that stows with the bleacher system. The bleacher system is adapted to move between an open position in which seating is available for use and a closed position in which rows of seating surfaces are vertically stacked. The system includes handrails adapted to move between a use position when the system is in the open position and a stowed position when the system is in a closed position. A post of the handrail includes a cam and a cylinder surrounding the post includes a cam slot. A ramp on a surface of the aisle step engages the post and raises the post within the cylinder as the bleacher system is moved into the open position. As the post is raised in the cylinder, the corresponding cam and cam slot cause rotation of the post.

12 Claims, 6 Drawing Sheets

(56) References Cited

U.S. PATENT DOCUMENTS

| | | | | |
|---|---|---|---|---|
| 5,820,110 | A | 10/1998 | Beu | |
| 5,853,166 | A | 12/1998 | Koza | |
| 6,041,554 | A | 3/2000 | McArthur, Jr. | |
| 6,185,875 | B1 | 2/2001 | Victor et al. | |
| 6,279,880 | B1 | 8/2001 | Hawks, Jr. | |
| 6,328,285 | B1 * | 12/2001 | Wiseman | 256/59 |
| 6,854,216 | B2 * | 2/2005 | Ahrens et al. | 52/9 |
| 2002/0056239 | A1 | 5/2002 | Paddock | |
| 2009/0039327 | A1 | 2/2009 | Kroll et al. | |

* cited by examiner

TELESCOPIC OR RETRACTABLE BLEACHER HANDRAIL AND SYSTEM

CROSS REFERENCE TO RELATED APPLICATIONS

This application claims priority under 35 U.S.C. §119(e) of U.S. Prov. Pat. Appl. No. 61/895,157, filled Oct. 24, 2013.

STATEMENT REGARDING FEDERALLY SPONSORED RESEARCH OR DEVELOPMENT

N/A

BACKGROUND OF THE INVENTION

The present invention relates to hand rails for telescopic or retractable bleacher systems.

Telescopic or retractable bleachers have been used to provide seating for spectators during events such as sporting events in areas that may be intended for multiple purposes, for example in a gymnasium. Typically, these types of bleachers provide multiple rows of seating in a stadium style arrangement. Once the spectator event has been completed it is advantageous to retract the bleachers thereby making available additional space for other activities. When the bleachers are retracted, each seating row is closed under the seating rows above.

The telescopic or retractable bleacher system may include handrails to assist spectators in ascending and descending the bleacher. In some cases, while the bleacher is in the open position, railings may be required in order to comply with applicable codes. Handrails have been positioned in the aisles to comply with such codes. When the bleacher is closed, the options of storing the aisle rail include removing, folding, and providing an opening for the rail where the rail nests over and under the decking of a row. In other cases, bleachers have been fitted with handrails that enable retraction of the bleachers without removal of the handrails, for instance, by mounting the upright posts to store in front of the closed bleacher by attachment to the riser boards or deck nosing. However, these handrails may provide further issues in that the horizontal portions of the handrails protrude from the face of the retracted bleachers and into the activity space—reducing the usable footprint.

Accordingly, there remains a need for handrails for use on bleacher systems that conveniently and safely avoid interfering with the bleachers and the activity space when the bleachers are moved into a retracted position and do not require a person to remove or fold the rail.

SUMMARY OF THE INVENTION

The present invention provides a telescopic or retractable bleacher system and handrail that will store with the bleacher system without use of tools. As the bleacher system is moved between an open or extended position in which seating is available for use and a closed position in which rows of seating surfaces are vertically stacked relative to one another, the handrail correspondingly moves from a use position to a stowed position. The post of the handrail includes a cam and an outer cylinder surrounding the post includes a cam slot. A ramp in a surface of the aisle of the system engages the post and raises the post within the outer cylinder. As the post is raised in the cylinder, the corresponding cam and cam slot cause rotation of the post thereby changing the orientation of the handrail.

In one embodiment a telescopic or retractable bleacher system includes a plurality of seating surfaces, an aisle adjacent to the seating surfaces, the aisle having a plurality of steps, and a handrail in the aisle that includes an elongated gripping portion. The bleacher system is adapted to move between an extended position whereby users may ascend and descend the steps of the aisle and a collapsed position whereby the plurality of seating surfaces are in a stacked arrangement. The handrail is adapted to move between a use position whereby the elongated gripping portion is substantially parallel with the aisle and a stowed position whereby the elongated gripping portion is substantially perpendicular to the aisle.

In one embodiment the extended position of the bleacher system corresponds to the use position of the elongated gripping portion of the handrail, and the closed or retracted position of the bleacher system corresponds to the stowed position of the elongated gripping portion of said handrail.

In one embodiment a stowable bleacher handrail has a post of the handrail and an elongated gripping portion at one end and a lower end opposite the elongated gripping portion. A cam is near the lower end of the post and an outer cylinder surrounds the post and has a cam slot and an attachment bracket. A ramp having a leading edge is adapted to move between a position in which the leading edge engages the lower end of the post and a position in which the lower end is elevated by the ramp. The cam is fitted into the cam slot and the cam is adapted to move between a higher point in the cam slot and a lower point in the cam slot relative to the position of the post on the ramp.

In one embodiment the elongated gripping portion is in a stowed position when the cam is at the lower point and the elongated gripping portion is in a use position when the cam is at the higher point.

DETAILED DESCRIPTION OF THE INVENTION

The bleacher system and handrail provide a safety feature for a telescopic or retractable bleacher. When the bleacher system is in a closed position, the rail may rotate to a stowed position thereby maximizing the space made available by closing the bleacher system. In one embodiment a post on the rail is constructed with a cam and the post may be fitted inside a telescoping cylinder having a slot for the cam of the post. The post may be mounted on a step, step riser, decking, or other surface of the pedestrian aisle section. An elongated handrail is fixed to the post and is capable of rotating from a "use" position that is substantially parallel with the aisle when the bleacher system is extended for use to a "stowed" position that is substantially perpendicular to the aisle when the bleacher system is collapsed.

Directional terms such as "vertical," "horizontal," "top," "bottom," "upper," "lower," "inside," "inner," "inwardly," "outside," "outer," and "outwardly,' are used to assist in describing the invention based on the orientation of the embodiments shown in the illustrations. The use of directional terms is merely an expedient to facilitate disclosure with reference to the illustrations and should not be interpreted to limit the invention carts of any specific orientation(s).

Figure 1:
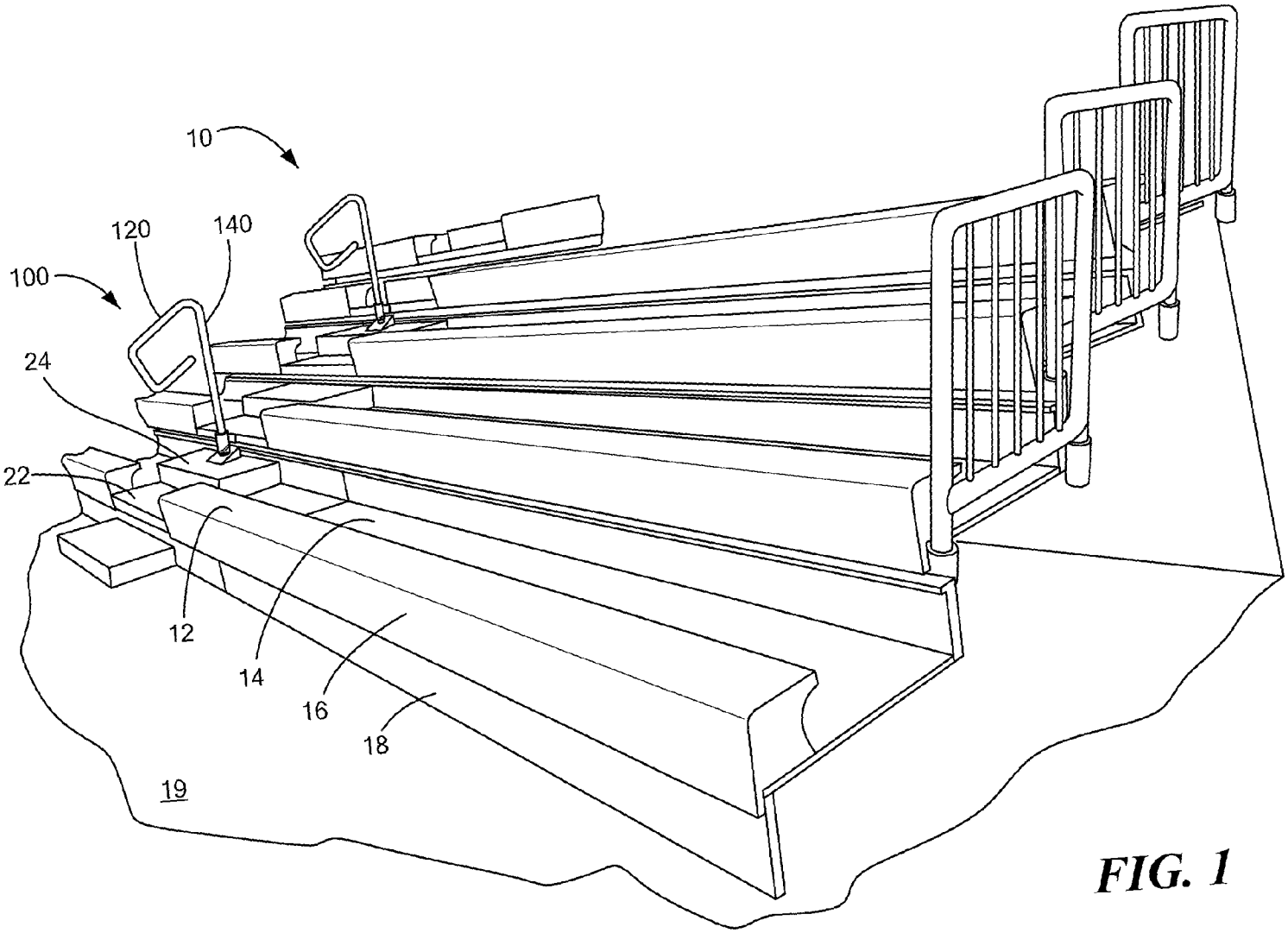
FIG. 1 is a perspective view of the bleacher system in an extended or open position.
Figure 2:
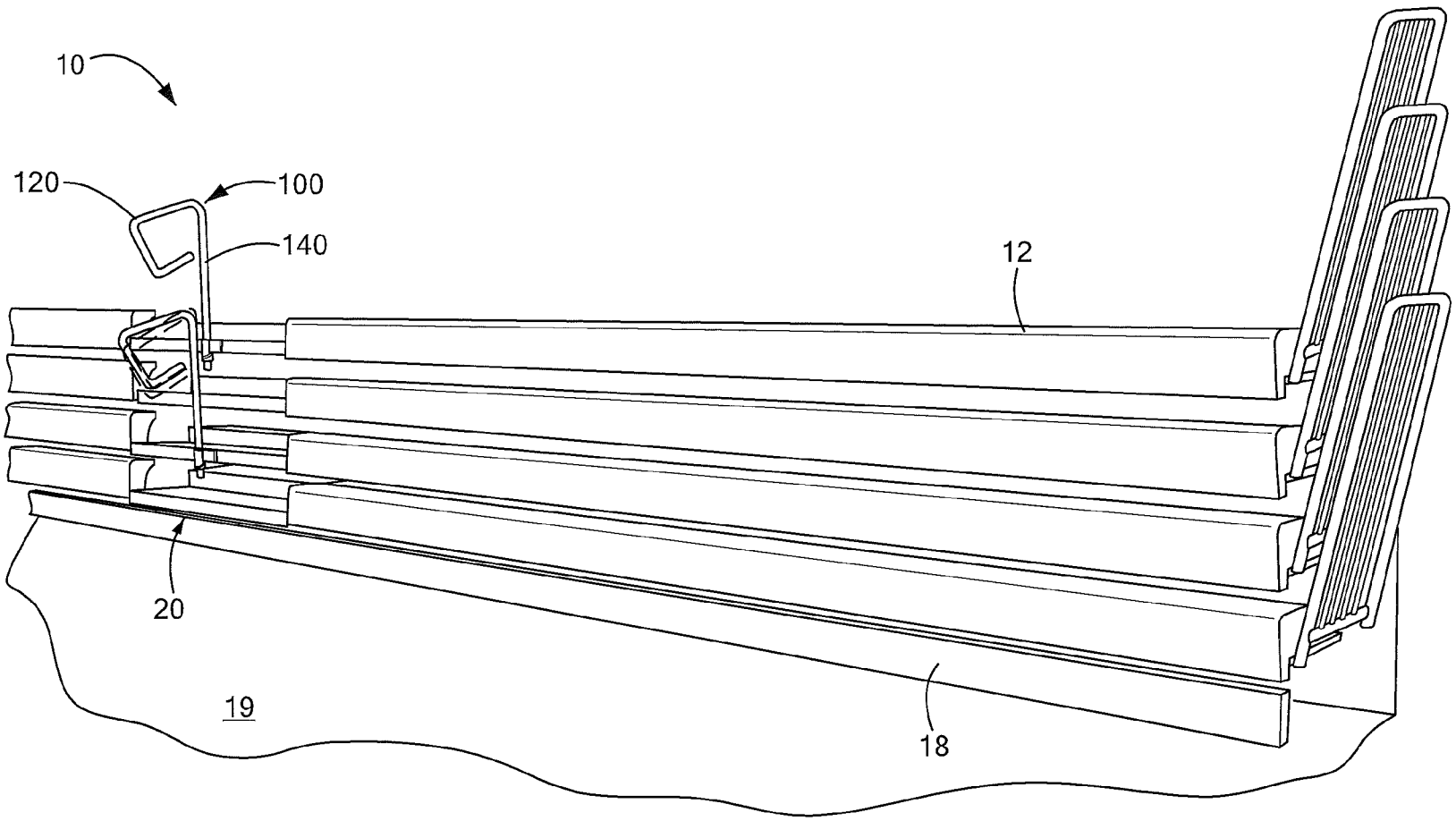
FIG. 2 is a perspective view of the bleacher system in a closed or retracted position.

A telescopic or retractable bleacher system in accordance with the present invention is shown in FIGS. 1-2 and is generally designated here as 10. The bleacher system 10 is capable of moving between an open position as shown in FIG. 1 and a closed position as shown in FIG. 2. In the open position, the bleacher system 10 includes a plurality of substantially horizontal seating surfaces 12 generally facing a floor 19 or viewing area and arranged in a stadium style arrangement with seating surfaces 12 to the rear (relative to the floor 19) being elevated above the seating surfaces 12 below it to provide an unobstructed view to anyone seated in a row other than the first row. Each row of seating surfaces 12 may include a decking surface 14 on which a person using the seating surface 12 may rest his or her feet. The seating surfaces 12 may also include a front surface 16 that is substantially vertical and generally extends from the seating surface 12 to the decking surface 14 near, or to, a riser 18. Each row of seating surface 12 may be fixed to a front end of the decking 14 that is provided as a walkway or footrest for the next row of seating surface 12 to the adjacent ascending row of seating so that the seating surface 12 is affixed to the decking 14 on an edge opposite the riser 18.

Figure 4:
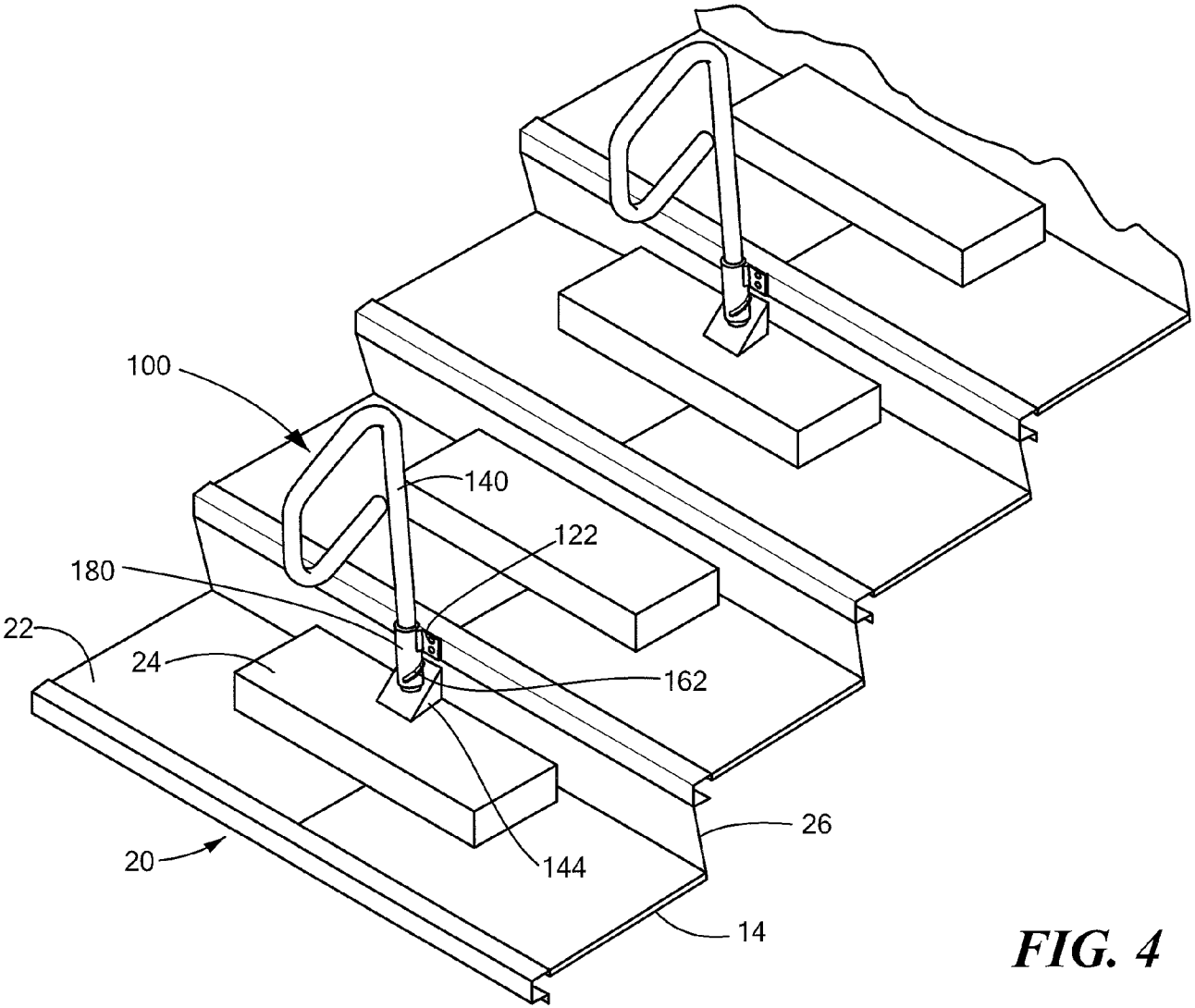
FIG. 4 is a detailed view of an aisle in the bleacher system in an open position.

The bleacher system 10 includes a pedestrian aisle 20 with a series of steps 22 allowing the gradual ascent from the floor 19 to the upper-most and/or rear-most row of seating surfaces 12 and passing by or through each intermediate row of seating surfaces 12. The aisle 20 may further serve as a separator of sections of the bleacher system 10. As shown in FIG. 4, the steps 22 may be an extension of the decking surface 14 or may be elevated above the decking surface 14, or may be a combination of the decking surface 14 with an intermediate step 24. Alternatively, the steps 22 may be constructed of alternating decking surfaces 14 and intermediate steps 24. This arrangement allows for shorter strides and a more gradual ascent and descent to be made by the user as compared to providing steps 22 corresponding only to the decking surface 14. The bleacher system 10 may further include a step riser 26 and/or an end cap or nosing 28 as substantially vertical transition components between the generally horizontal steps 22 in the aisle 20.

Figure 5:
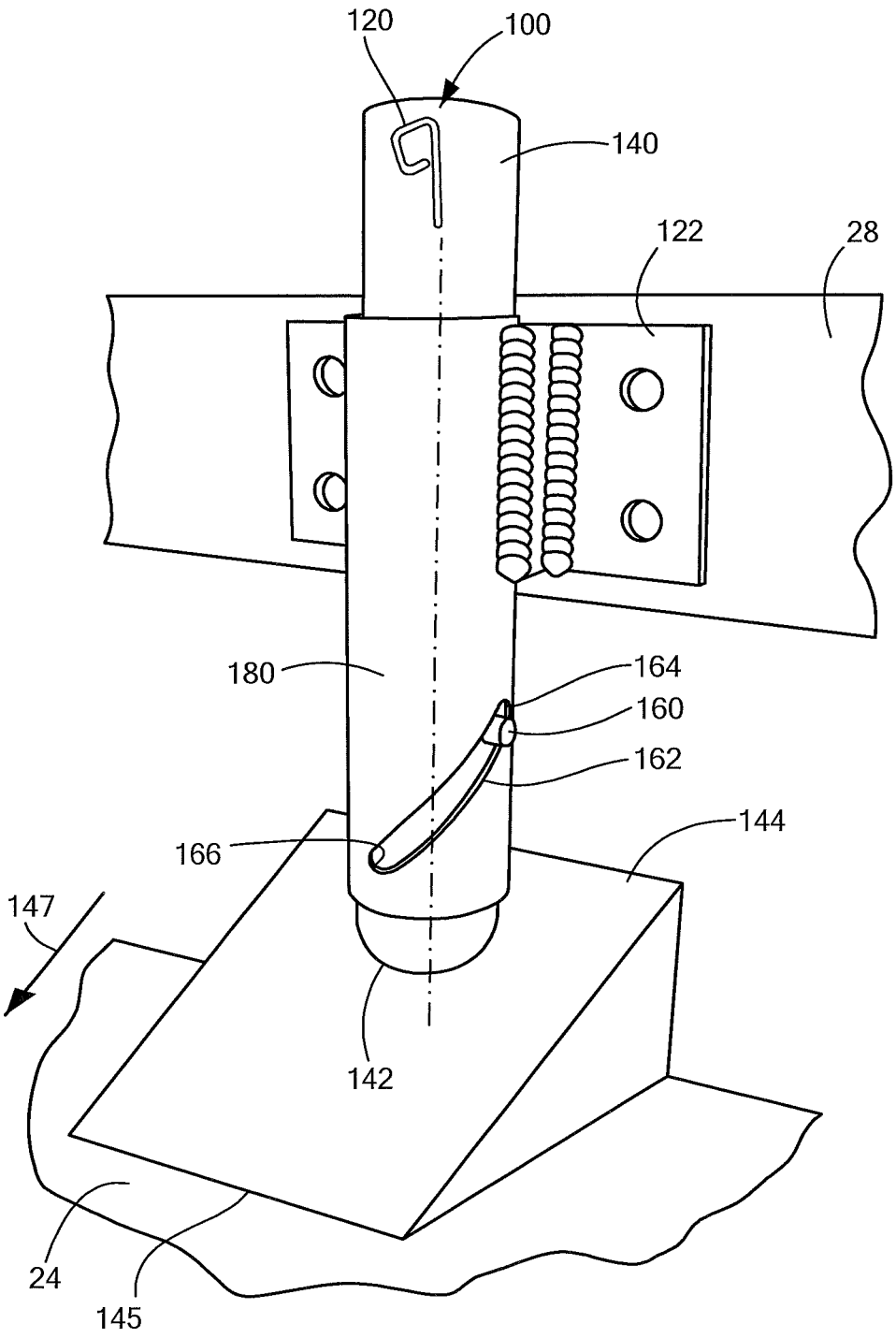
FIG. 5 is a detailed view of the handrail rotating mechanism in a use position.
Figure 6:
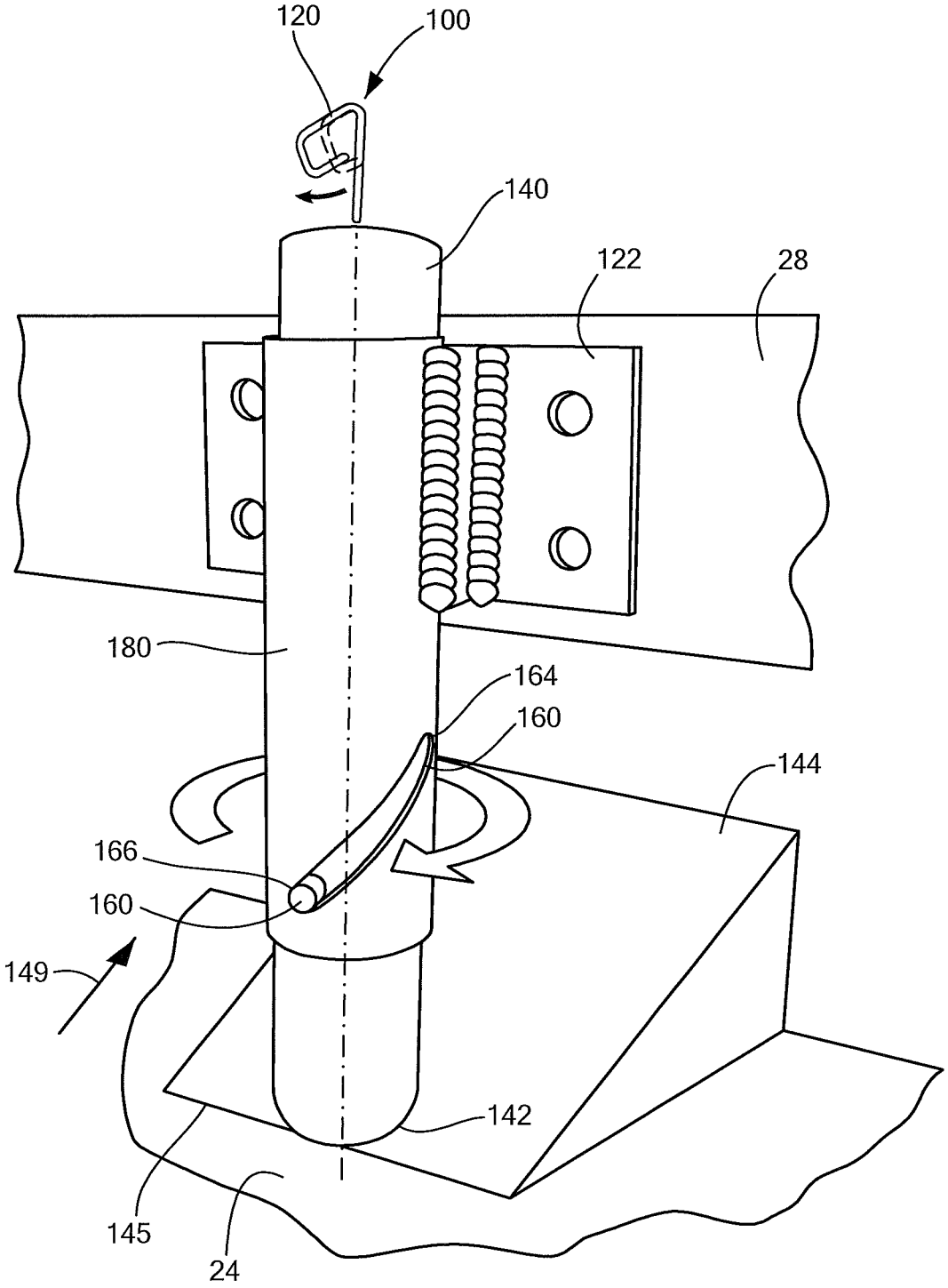
FIG. 6 is a detailed view of the handrail rotating mechanism is a stowed position.

One or more handrails 100 may be mounted in or along the aisle 20. The handrail 100 has a generally horizontal gripping portion 120 and a generally upright post 140. The gripping portion 120 may be elongated and, when the bleacher system 10 is in the extended position, aligned substantially parallel with the aisle 20 and generally perpendicular to the rows of seating surfaces 12. In the illustrated embodiment, the gripping portion is in the form of a loop, such that the handrail forms a generally "P" shape, although a variety of other shapes and configurations may be used. As best shown in FIGS. 5-6, the post 140 may be a cylindrical tube that includes a cam 160 and may be fitted in an outer cylinder 180 in a telescoping arrangement, wherein the post 140 is capable of rotating within the outer cylinder 180 and also capable of sliding vertically within the outer cylinder 180. In the illustrated embodiment, the outer cylinder 180 includes a cam slot 162 through which the cam 160 may be fitted. The cam slot 162 may be formed in the circumference of the outer cylinder 180 and may have a higher end 164 and a lower end 166 that are spaced apart longitudinally along the outer cylinder 180. The slot 162 may further be angled or curved between the higher end 164 and the lower end 166 such that it extends about a portion of the circumference of the outer cylinder 180. In the illustrated embodiment, the cam slot 162 is curved between the higher end 164 and lower end 166 with the two ends thereof being radially separated about the cylinder vertical axis by approximately 90 degrees. Flanges 122 or brackets affixed to the outside surface of the outer cylinder 180 facilitate the attachment of the handrail 100 to the bleacher system 10 for example on the step riser 26 or nosing 28. As illustrated, the post 140 has a lower end 142 that contacts a ramp 144 installed on bleacher system 100. The ramp 144 may be located on the decking 14, intermediate step 24 or other location provided the ramp 144 is positioned to engage the lower end 142 of the post 140 as the bleacher system 10 is moved from a closed position to an open position. Although the system is shown with the cam extending from the post and the cam slot defined in the outer cylinder, other cam arrangements may be utilized. For example, the system may include a slot in the post, and a cam protrusion extending inwardly from the outer cylinder into the slot in the post.

Figure 3:
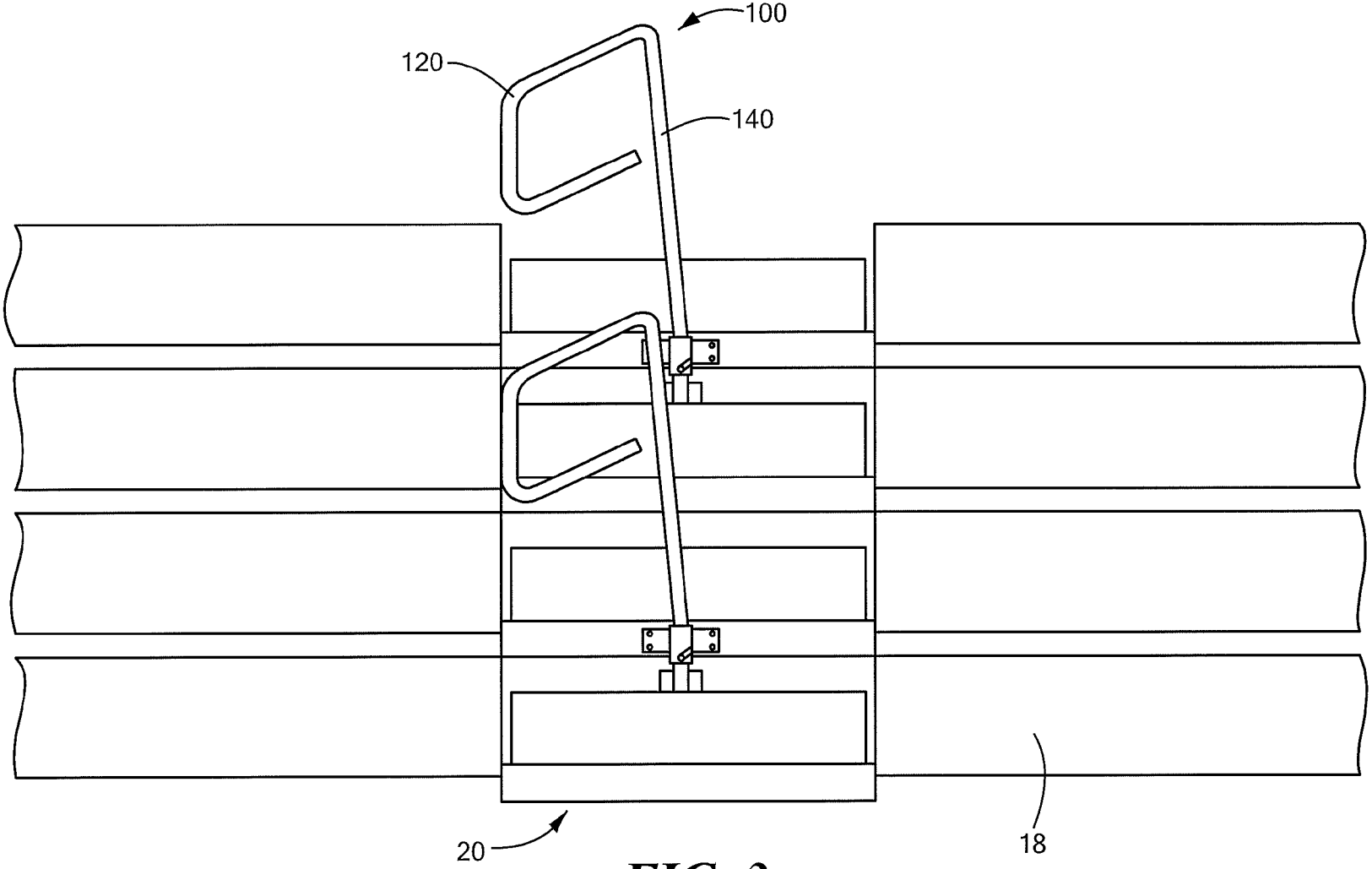
FIG. 3 is a front view of the bleacher system in a retracted position.

As best shown in FIGS. 2-3 the bleacher system 10 may be closed or refracted to grant access to the area or floor space that is covered or occupied by the bleacher system 10 when it is extended. In the closed position, the decking 14 for each row of seating surface 12 is retracted beneath the associated seating surface 12. If there is an associated riser 18, the riser 18 may similarly be retracted beneath the seating surface 12. Generally, the closing of the bleacher system 10 from an extended position is initiated, after the release of any stops or brakes (not shown), by pushing or otherwise moving the lowest or first row of seating surfaces 12 so that the decking 14 of the next higher row will be stacked above the lowest or first row. Subsequently, the bleacher system 10 continues to collapse by facilitating the movement of the first two stacked rows beneath the next higher row until all of the rows of seating surfaces 12 are in a vertically stacked relationship to one another. Alternatively, the closing of the bleacher system 10 may be accomplished by simultaneously moving each level of decking 14 beneath the corresponding seating surface 12 such as by hydraulic assistance, for example. In the fully stacked or closed or collapsed position, the bleacher system 10 has a width substantially that of one section of decking 14. As the seating surfaces 12 of the bleacher system 10 are stacked, the handrails 100 rotate from the use position with the elongated gripping portion 120 substantially parallel with the aisle 20 to a stowed position in which the elongated gripping portion 120 is substantially perpendicular to the aisle 20. The rotation in position of the handrail 100 is due to the movement of the cam 160 in the cam slot 162 as the lower end 142 of the post 140 engages or disengages the ramp 144.

The rotation and resulting turn of the handrail 100 may be accomplished, as an example, in the following way. Moving from the closed or retracted position of the bleacher system 10 to the open position, the ramp 144 mounted on a step 22 or intermediate step 24 at or near the step riser 26 moves forward in the direction indicated by arrow 147 in FIG. 5. The leading edge 145 of the ramp 144 contacts the lower end 142 of the post 140. As extension of the bleacher system 10 continues in the direction in of the arrow 147, the lower end 142 of the post 140 travels up the ramp 144 causing the post 140 to be lifted inside the outer cylinder 180. As the post 140 is lifted or moves upward within the outer cylinder 180, the cam 160 moves from the lower end 166 of the cam slot 162 toward the higher end 164 of the cam slot 162 that is curved within the wall of the outer cylinder 180. As upward linear motion is created on the post 140 by the ramp 144, the linear motion is transferred to rotational movement of the post 140 by the change in position of the cam 160 along the circumference of the outer cylinder 180. The gripping portion 120 of the handrail 100, being fixed relative to the post 140, similarly rotates from a position substantially perpendicular to the aisle 20 to a position in which the gripping portion 120 is substantially parallel to the aisle 20 along the direction users would ascend or descend.

During closure or closing of the bleacher system 10 from an extended position, the ramp 144 may move in the reverse direction as indicated by arrow 149 in FIG. 6. Movement of the ramp 144 in the reverse direction 149 causes the lower end 142 of the post 140 to descend the ramp 144. The downward linear movement of the post 140 as it descends the ramp 144 is transferred to rotational movement of the post 140 by the change in position of the cam 160. During collapse of the bleacher system, the cam 160 moves from the higher end 164 of the cam slot 162 toward the lower end 166 of the cam slot. The gripping portion 120 of the handrail 100 similarly rotates from a position substantially parallel to the aisle 20 to a position substantially parallel to the aisle.

It should be understood that the higher end 164 and lower end 166 of the cam slot may be in the reversed positions, if desired, relative to the position of the elongated gripping portion 120. Any arrangement of cam 160, cam slot 162 and gripping portion 120 of the handrail may be constructed to allow any desired range of rotational movement of the gripping portion 120. For the bleacher system 10 described herein the rotational range of the elongated gripping portion 120 of the handrail 100 is about 90 degrees.

The ramp 144 may be constructed in any length to height ratio. The steepness of the ramp 144 can control the speed at which the position of the gripping portion 120 changes and can control the amount of force required to initiate movement of the lower end 142 of the post 140 up or down the ramp 144. As an alternative to providing a ramp, the lower end of the post may be angled to function as a ramp that is capable of interacting with a step, intermediate step or other protrusion on the bleacher system 10 to facilitate the linear movement required for rotation of the gripping portion of the handrail 100.

The post 140 may be secured in place when the elongated gripping portion 120 of the handrail 100 is in its use or extended position (parallel to the aisle 20) by providing any one or a combination of fitting elements. For example, corresponding or complementary pairs of bumps, protrusions, ramps, notches, landings or ridges, etc. on the lower end 142 of the post 140 can contribute to the stability of position of the gripping surface 120 and may provide audible or tactile confirmation to the operator of the bleacher system 10 that handrail 100 is in position for use. While any variety of fitting elements may be used, the features of the fittings may vary in shape and size. The steepness of any ramps and notches for this purpose may vary, for example, to control the amount of force desired to secure the position of the post 140 relative to the ramp 144 or to undo the secured position.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

What is claimed is:

1. A telescopic and retractable bleacher system, comprising:

a plurality of seating surfaces on a plurality of deck assemblies;

an aisle adjacent to the seating surfaces, the aisle having a plurality of steps; and a handrail in the aisle, the handrail including an elongated gripping portion, wherein the bleacher system is adapted to move between an open position whereby users may ascend and descend the steps of the aisle and a closed position whereby the plurality of seating surfaces and the steps are in a vertically stacked arrangement, wherein the handrail has a use position whereby the elongated gripping portion is substantially parallel with the aisle and a stowed position whereby the elongated gripping portion is substantially perpendicular to the aisle, wherein the handrail is automatically rotated between the use position, when the bleacher system is in the open position, and the stowed position, when the bleacher system is in the closed position, wherein the handrail comprises a substantially vertical post, the post having the gripping portion at an upper end thereof and a lower end, and a cylinder for supporting the post in a substantially vertical orientation and for allowing the post to automatically rotate between the use position and the stowed position, wherein the cylinder comprises an arcuate slot formed in the circumference of the cylinder and has a first lower end and a second higher end, wherein the first end is offset substantially ninety degrees about the post from the second end, wherein the first end is below the second end, and wherein the slot is angled with respect to a vertical axis between the first end and the second end, and wherein the post further comprises a cam that travels within the arcuate slot in the cylinder.

2. The bleacher system of claim 1, wherein the open position of the bleacher system corresponds to the use position of the handrail, and the closed position of the bleacher system corresponds to the stowed position of the handrail.

3. The bleacher system of claim 1, further comprising a ramp, having an inclined, upper surface, rigidly fixed to one of the steps adjacent the handrail, wherein as the bleacher system is moved into the open position, the lower end of the post travels up the inclined, upper surface of the ramp and as the bleacher system is moved into the closed position, the ramp moves horizontally, out of contact with the lower end of the post.

4. The bleacher system of claim 3, wherein the post moves upward within the cylinder as the bleacher system is moved into the open position and moves downward within the cylinder as the bleacher system is moved into the closed position.

5. The bleacher system of claim 4, wherein as the post moves upward or downward the handrail rotates as the cam moves within the arcuate slot.

6. The bleacher system of claim 1, wherein the cylinder is affixed to a front surface of one of the plurality of deck assemblies.

7. A stowable bleacher handrail system, comprising:

a substantially vertical handrail post having an elongated gripping portion at an upper end of the post and a lower end opposite the elongated gripping portion;

a cam projecting from the post;

a cylinder surrounding a portion of the post and having an arcuate cam slot in which the cam is adapted to travel, the arcuate cam slot having an upper end and a lower end, the upper and lower ends of the cam slot being separated about a vertical axis of the post and separated by a first vertical dimension, the cam slot being angled with respect to the vertical axis between the upper end and the lower end; and a ramp having an upper, inclined surface, the ramp adapted to move horizontally with respect to the handrail and the cylinder between a first position in which the post lower end is not in contact with the ramp upper, inclined surface and a second position is which the post lower end is in mechanical contact with the ramp upper, inclined surface, wherein the post is raised as the ramp is moved horizontally from the first position to the second position, through the mechanical contact between the ramp upper, inclined surface and the post lower end, and is lowered as the ramp is moved horizontally from the second position to the first position, through the mechanical contact between the ramp upper, inclined surface and the post lower end, wherein the cylinder is vertically fixed with respect to the ramp, and wherein, as the post is raised or lowered, the cam follows the arcuate cam slot, thereby rotating the post about the vertical axis of the post.

8. The handrail system of claim 7, wherein the elongated gripping portion is in a stowed position when the post is lowered and the cam is at the lower end of the cam slot and the elongated gripping portion is in a use position when the post is raised and the cam is at the upper end of the cam slot.

9. The handrail system of claim 7, wherein the cylinder comprises a bracket for mounting the bracket to a surface proximate the ramp.

10. The handrail system of claim 7, wherein the upper and lower ends of the cam slot are separated by substantially ninety degrees about the vertical axis of the post whereby, as the post is raised or lowered, the cam follows the arcuate cam slot, thereby rotating the post by substantially ninety degrees about the vertical axis of the post.

11. A method of providing a deployable handrail for use with a bleacher system, comprising:

providing the handrail having a substantially vertical post in a cylindrical receiver mounted to a deck assembly of the bleacher system;

providing a cam on the post and an arcuate slot in the receiver, the cam adapted for traveling within the slot, the slot having an upper end and a lower end, the upper and lower ends of the cam slot being separated about a vertical axis of the post and separated by a first vertical dimension, the cam slot being angled with respect to the vertical axis between the upper end and the lower end;

providing a ramp having an inclined, upper surface, the ramp being disposed on and affixed to a step of the bleacher system proximate a lower end of the post; and moving the bleacher system from a closed position to an open position, whereby the ramp upper, inclined surface is drawn into mechanical communication with the post lower end, forcing the post upwards and rotating the post through movement of the cam along with arcuate slot, thereby automatically rotating the handrail from a stowed position to a deployed position.

12. The method of claim 11, further comprising moving the bleacher system from the open position to the closed position, whereby the ramp upper, inclined surface is moved out of mechanical communication with the post lower end, allowing the post to move downwards and rotating the post through movement of the cam along the arcuate slot, thereby automatically rotating the handrail from the deployed position to the stowed position.

* * * * *